US007154061B2

(12) United States Patent
Eley et al.

(10) Patent No.: US 7,154,061 B2
(45) Date of Patent: Dec. 26, 2006

(54) INTERRUPTER ASSEMBLY FOR A CIRCUIT BREAKER

(75) Inventors: Edgar R. Eley, Jackson, TN (US); Robert L. Still, Jr., Columbia, MO (US)

(73) Assignee: ABB Inc., Raleigh, NC (US)

( * ) Notice: Subject to any disclaimer, the term of this patent is extended or adjusted under 35 U.S.C. 154(b) by 152 days.

(21) Appl. No.: 10/895,653

(22) Filed: Jul. 21, 2004

(65) Prior Publication Data

US 2006/0017531 A1 Jan. 26, 2006

(51) Int. Cl.
*H01H 3/00* (2006.01)

(52) U.S. Cl. ..... 218/154; 218/90; 218/103

(58) Field of Classification Search ..... 335/160–190; 218/90–110, 154
See application file for complete search history.

(56) References Cited

U.S. PATENT DOCUMENTS

| | | | | | |
|---|---|---|---|---|---|
| 1,862,782 | A | * | 6/1932 | Anderson | 218/27 |
| 1,980,471 | A | * | 11/1934 | Burnham | 218/103 |
| 2,385,008 | A | * | 9/1945 | Baker et al. | 218/107 |
| 2,406,469 | A | * | 8/1946 | Ludwig et al. | 218/103 |
| 2,419,123 | A | * | 4/1947 | Cumming | 218/103 |
| 2,420,888 | A | * | 5/1947 | Leeds | 218/107 |
| 2,669,628 | A | * | 2/1954 | Van Sickle | 218/103 |
| 2,671,147 | A | * | 3/1954 | Leeds | 218/103 |
| 3,272,947 | A | | 9/1966 | Kobryner | |
| 3,593,229 | A | | 7/1971 | Date | 335/29 |
| 3,739,229 | A | | 6/1973 | Moran | 317/22 |
| 3,750,064 | A | | 7/1973 | Kato et al. | 335/208 |
| 4,434,411 | A | | 2/1984 | Anderson, III et al. | 335/208 |
| 4,435,690 | A | | 3/1984 | Link et al. | 335/37 |
| 4,454,491 | A | | 6/1984 | Martus | 335/208 |
| 4,521,823 | A | | 6/1985 | Link | 361/38 |
| 4,550,298 | A | | 10/1985 | Mikulecky | 335/35 |
| 4,591,816 | A | | 5/1986 | Mikulecky et al. | 335/6 |
| 4,611,189 | A | | 9/1986 | Mikulecky | 335/37 |
| 4,617,545 | A | | 10/1986 | Link | 337/74 |
| 4,737,878 | A | | 4/1988 | Milkulecky | 361/37 |
| 4,767,347 | A | | 8/1988 | Kamp et al. | 439/133 |
| 4,779,162 | A | | 10/1988 | Beitz et al. | 361/127 |
| 4,845,593 | A | | 7/1989 | Brown et al. | 361/192 |
| 4,908,730 | A | | 3/1990 | Westrom | 361/120 |

(Continued)

FOREIGN PATENT DOCUMENTS

CA 1 194 061 9/1985

(Continued)

OTHER PUBLICATIONS

Cooper Power Systems, "OEM Equipment-Sectionalizing Switches", Jan. 1990, 5 pages.

(Continued)

*Primary Examiner*—Lincoln Donovan
(74) *Attorney, Agent, or Firm*—Woodcock Washburn LLP

(57) ABSTRACT

A preferred embodiment of an interrupter assembly for a circuit breaker includes a first contact, a conductor, and a second contact mounted on the conductor. The second contact and the conductor are movable in relation to the first contact between a first position wherein the first and the second contacts are in electrical contact, and a second position. The interrupter assembly also includes a body having a first and a second half each having a plurality of recesses formed therein. The recesses form chambers within the body for holding insulating fluid when the first and the second halves are mated. The body receives the second contact and the conductor so that the conductor and the second contact are drawn through the chambers as the second contact moves from the first to the second position.

28 Claims, 8 Drawing Sheets

U.S. PATENT DOCUMENTS

| | | | | |
|---|---|---|---|---|
| 4,930,039 | A | 5/1990 | Woodworth et al. | 361/127 |
| 4,975,797 | A | 12/1990 | Veverka et al. | 361/35 |
| 5,113,311 | A | 5/1992 | Kamp et al. | 361/346 |
| 5,220,480 | A | 6/1993 | Kershaw, Jr. et al. | 361/117 |
| 5,608,596 | A | 3/1997 | Smith et al. | 361/118 |
| 6,111,212 | A | 8/2000 | DuPont et al. | 218/90 |

FOREIGN PATENT DOCUMENTS

| | | |
|---|---|---|
| CA | 1 228 623 | 10/1987 |
| CA | 1 242 755 | 10/1988 |
| CA | 1 252 176 | 4/1989 |
| KR | 8 901 721 | 5/1989 |
| KR | 9 007 274 | 10/1990 |
| KR | 9 400 152 | 1/1994 |
| KR | 9 400 153 | 1/1994 |
| TW | 0 396 355 | 7/2000 |

OTHER PUBLICATIONS

P & A Power Systems, Inc-Marketing by Ardry Trading Company, Inc., "OLBS-Oil Insulated Load Break Switch for Distribution Transformer", Brochure 7 pages, no date.

* cited by examiner

INTERRUPTER ASSEMBLY FOR A CIRCUIT BREAKER

FIELD OF THE INVENTION

The present invention relates to circuit breakers for breaking a current path in an electrical device such as a distribution transformer. More specifically, the invention relates to an interrupter assembly for a circuit breaker.

BACKGROUND OF THE INVENTION

Distribution transformers and other types of electrical devices are often subject to over-current (fault) or over-temperature conditions caused by factors such as electrical shorts across distribution lines, internal electrical shorts, overheating, etc. Over-current and over-temperature conditions can damage or destroy a distribution transformer if adequate protection against such conditions is not provided.

Distribution transformers typically are equipped with circuit breakers that interrupt, or break the current path between the primary winding and an associated voltage source in response to an over-current or over-temperature condition.

Circuit breakers usually include a moving contact and a stationary contact. The moving and stationary contacts are in electrical and mechanical contact during normal operation of the distribution transformer, and form part of the current path between the primary winding and the voltage source. The circuit breaker causes the moving contact to separate from the stationary contact in response to an over-current or over-temperature condition, thereby breaking the current path between the primary winding and the voltage source and protecting the distribution transformer from the over-current or over-temperature condition.

An electric arc forms between the moving and stationary contacts as the moving contact separates and is drawn away from the stationary contact. The arc represents a potential safety hazard, and therefore should be extinguished as quickly as possible. The stationary and moving contacts typically are housed within a chamber of an interrupter assembly of the circuit breaker. The chamber is filled with an insulating fluid, e.g., transformer oil, that helps to extinguish the arc.

The insulating fluid can vaporize in response to the heat generated by the arc. Vaporization of the insulating fluid is not desirable, as vaporized insulating fluid is less effective at extinguishing the arc than non-vaporized insulating fluid.

Circuit breakers that address the problem of arc-induced insulating fluid vaporization have been developed. For example, one particular type of circuit breaker comprises a housing formed from stackable cylinders that each form an individual arc chamber. The arc chambers, upon stacking, are aligned so that the moving contact can be drawn therethrough during separation from the stationary contact.

The use of multiple arc chambers is believed to be more effective at extinguishing the arc than a single chamber. The need to manufacture and stack a plurality of individual cylinders, however, can increase the parts count of the circuit breaker, and can increase the number of steps in the assembly process for the circuit breaker.

SUMMARY OF THE INVENTION

A preferred embodiment of an interrupter assembly for a circuit breaker comprises a first and a second stationary contact, and a moving contact assembly. The moving contact assembly comprises a substantially U-shaped conductor, a first moving contact mounted on a first end of the conductor, and a second moving contact mounted on a second end of the conductor. The moving contact assembly is movable between a first position wherein the first and second moving contacts are in electrical contact with the respective first and second stationary contacts, and a second position wherein the first and second moving contacts are electrically isolated from the respective first and second stationary contacts.

The interrupter assembly also comprises a body having a first and a second half each having a plurality of recesses formed therein. The recesses formed in the first half face corresponding ones of the recesses formed in the second half to form chambers for holding insulating fluid when the first and the second halves are mated. The body receives the moving contact assembly so that the first and the second moving contacts are drawn through respective ones of the chambers as the moving contact assembly moves from the first to the second position.

Another preferred embodiment of an interrupter assembly for a circuit breaker comprises a first and a second stationary contact, and a moving contact assembly. The moving contact assembly comprises a conductor having a first leg, a second leg adjoining the first leg, and a third leg adjoining the second leg. The first and third legs are substantially perpendicular to the second leg and have substantially the same length so that the conductor is substantially U-shaped.

The interrupter assembly also comprises a first moving contact mounted on the first leg, and a second moving contact mounted on the second leg. The moving contact assembly is movable between a first position wherein the first and the second moving contacts electrically and mechanically contact the respective first and second stationary contacts, and a second position wherein the first and second moving contacts are electrically isolated from the respective first and second stationary contacts.

Another preferred embodiment of an interrupter assembly for a circuit breaker comprises a first contact, a conductor, and a second contact mounted on the conductor. The second contact and the conductor are movable in relation to the first contact between a first position wherein the first and the second contacts are in electrical contact, and a second position.

The interrupter assembly also comprises a body having a first and a second half each having a plurality of recesses formed therein. The recesses form chambers within the body for holding insulating fluid when the first and the second halves are mated. The body receives the second contact and the conductor so that the conductor and the second contact are drawn through the chambers as the second contact moves from the first to the second position.

Another preferred embodiment of an interrupter assembly for a circuit breaker comprises a first contact, a conductor, and a second contact mounted on the conductor. The second contact and the conductor are movable in relation to the first contact between a first position wherein the first and the second contacts are in electrical contact, and a second position wherein the second contact is electrically isolated from the first contact.

The interrupter assembly also comprises a body for receiving the first and the second contacts and the conductor. The body comprises a first and a second half, and has a plurality of chambers formed therein for holding insulating fluid. Each chamber is defined by a recess formed in the first half, and a corresponding recess formed in the second half that adjoins the recess formed in the first half when the first and second halves are mated. The second contact is drawn through the chambers when the second contact moves from the first to the second position.

A preferred method for assembling an interrupter assembly for a circuit breaker comprises providing a body for the interrupter assembly, the body comprising a first and a second half each having a plurality of recesses fore therein. The method also comprises mating the first and second halves so that the recesses form chambers for holding insulating fluid and for receiving a moving contact of the interrupter assembly.

A preferred embodiment of a circuit breaker comprises an interrupter assembly comprising a first and a second stationary contact, and a moving contact assembly. The moving contact assembly comprises a substantially U-shaped conductor, a first moving contact mounted on a first end of the conductor, and a second moving contact mounted on a second end of the conductor. The moving contact assembly is movable between a first position wherein the first and second moving contacts are in electrical contact with the respective first and second stationary contacts, and a second position wherein the first and second moving contacts are electrically isolated from the respective first and second stationary contacts.

The interrupter assembly also comprises a body having a first and a second half each having a plurality of recesses formed therein. The recesses formed in the first half face corresponding ones of the recesses formed in the second half to form chambers for holding insulating fluid when the first and the second halves are mated. The body receives the moving contact assembly so that the first and the second moving contacts are drawn through respective ones of the chambers as the moving contact assembly moves from the first to the second position.

The circuit breaker also comprises an actuator assembly for moving the moving contact assembly from the first to the second position. The actuator assembly comprises a contact arm mechanically coupled to the conductor, and a spring for biasing the contact arm. The circuit breaker further comprises a current sensor assembly for activating the actuator mechanism in response to over-temperature and over-current conditions.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DESCRIPTION OF PREFERRED EMBODIMENTS

A preferred embodiment of a circuit breaker 10 is depicted in FIGS. 1–9. The circuit breaker 10 can be installed in a distribution transformer 100 (see FIG. 9). The circuit breaker 10 can be electrically connected to a primary winding 102 of the distribution transformer 100, and to a voltage source 104 used to energize the primary winding 102. The circuit breaker 10 can be used to interrupt (break) the current path between the primary winding 102 and the voltage source 104 in response to an over-current (fault) or over-temperature condition.

It should be noted that a particular application for the circuit breaker 10 is specified for exemplary purposes only. The circuit breaker 10 can be used with other types of electrical equipment that require interruption of a current path in response to one or more predetermined over-current or over-temperature conditions.

Figure 1:
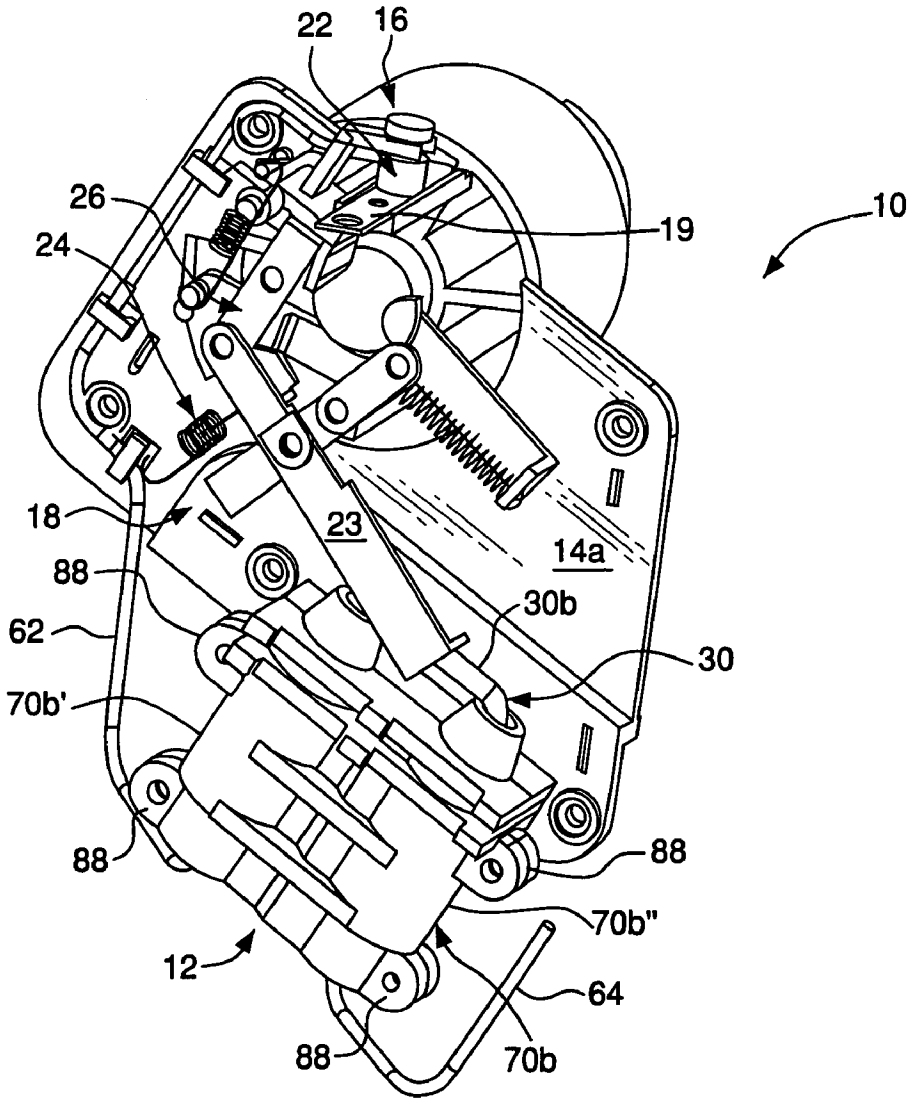
FIG. 1 is a top-side perspective view of a preferred embodiment of a circuit breaker, with a second half of a back plate of the circuit breaker removed.
Figure 2:
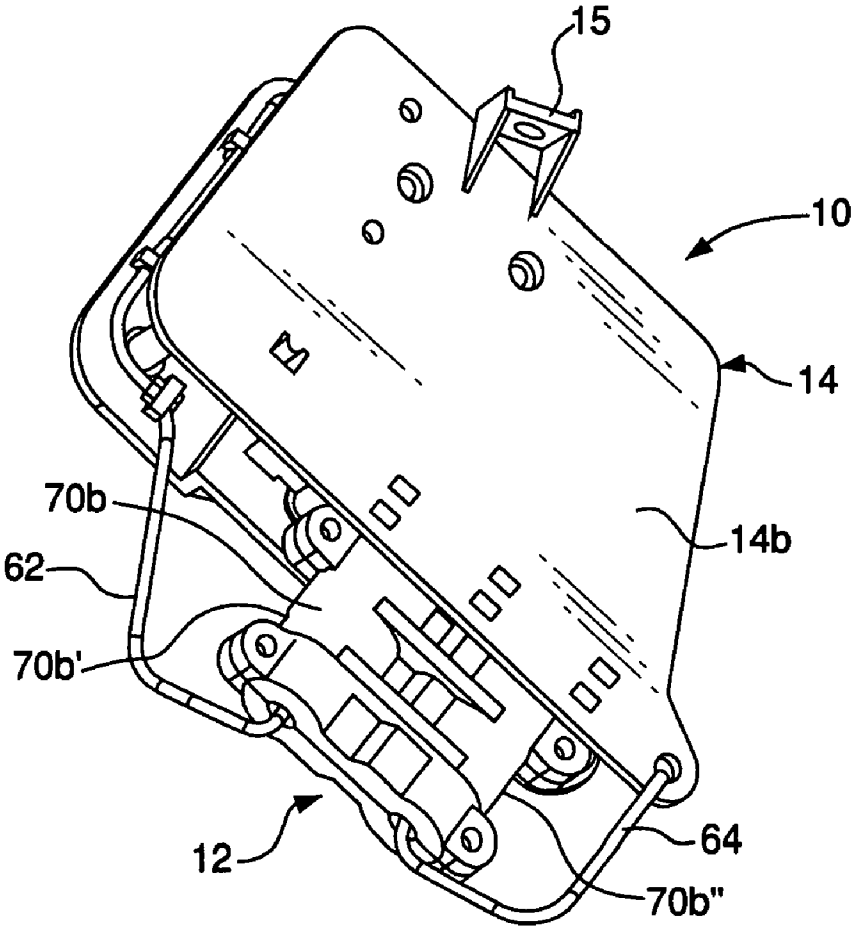
FIG. 2 is a bottom-side perspective view of the circuit breaker shown in FIG. 1, in a fully assembled state.
Figure 3:
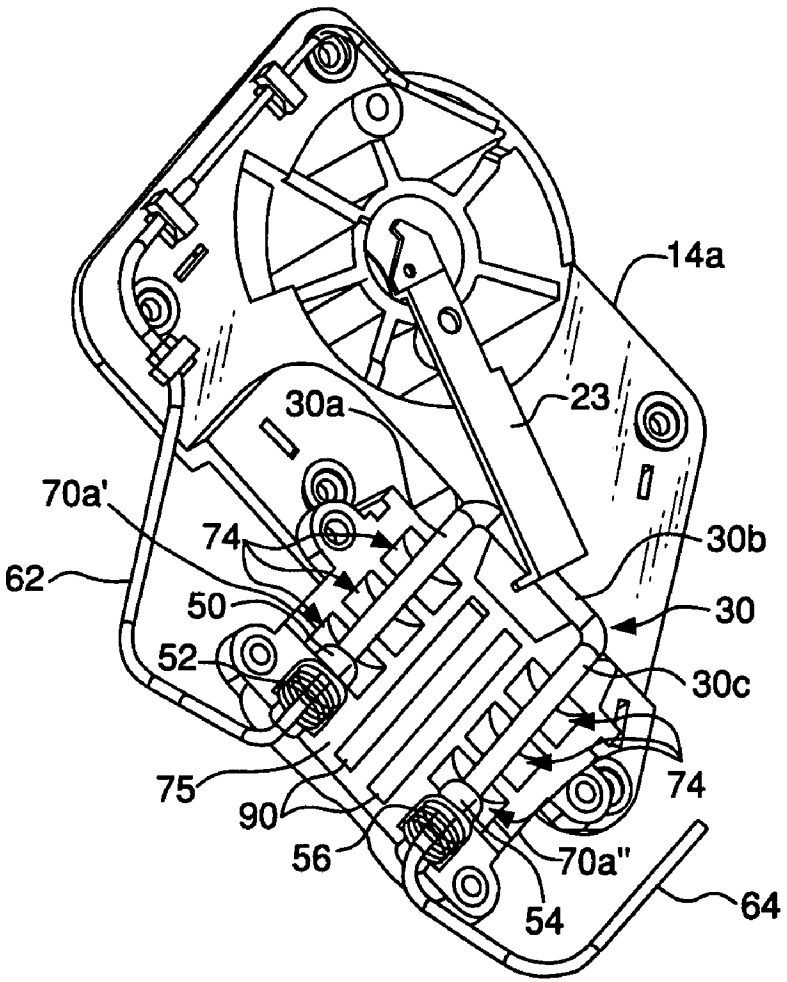
FIG. 3 is a bottom-side perspective view of the circuit breaker shown in FIGS. 1 and 2, with the second half of the back plate removed, and a second half of a housing of an interrupter assembly of the circuit breaker removed.

The circuit breaker 10 comprises an interrupter assembly 12, and a back plate 14 having a first half 14*a* and a second half 14*b* (see FIGS. 1–3). The circuit breaker 10 can be mounted on the distribution transformer 100 by way of flanges 15 formed in each of the first and second halves 14*a*, 14*b*. (The circuit breaker 10 typically is mounted within the distribution transformer 100, and is immersed in the insulating fluid, e.g., transformer oil, of the distribution transformer 100.)

The interrupter assembly 12 is mounted on the back plate 14 so that a portion of the interrupter assembly 12 is sandwiched between the first and second halves 14*a*, 14*b*. The interrupter assembly 12, as discussed below, forms part of the current path between the primary winding 102 and the voltage source 104, and can break the current path in response to predetermined over-current and over-temperature conditions.

The circuit breaker 10 also includes a current sensor assembly 16 and an actuator assembly 18 (see FIG. 2). The current sensor assembly 16 releases the actuator assembly 18 in response to a predetermined over-current condition in the current path between the primary winding 102 and the voltage source 104, or in response to a predetermined over-temperature condition within the distribution transformer 100. The actuator assembly 18, upon release, actuates the interrupter assembly 12 to break the current path between the primary winding 102 and the voltage source 104.

The current sensor assembly 16 is located in the current path between the interrupter assembly 12 and the primary winding 102. (The current sensor assembly 16 includes a tab 19 for connecting the current sensor assembly 16 to a lead (not shown) of the primary winding 102.) The current sensor assembly 16 can be a thermal-magnetic sensor comprising a magnetic element 22 (see FIG. 2).

Figure 5B:
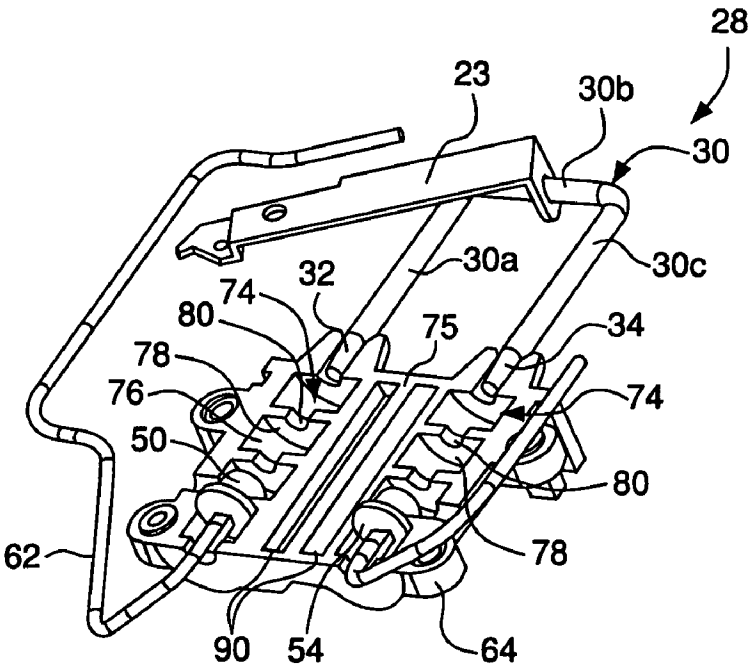
FIG. 5B is a bottom-side perspective view of the interrupter assembly shown in FIGS. 3–5A, with the second half of the housing removed and showing the moving contact assembly in an open position.
Figure 5A:
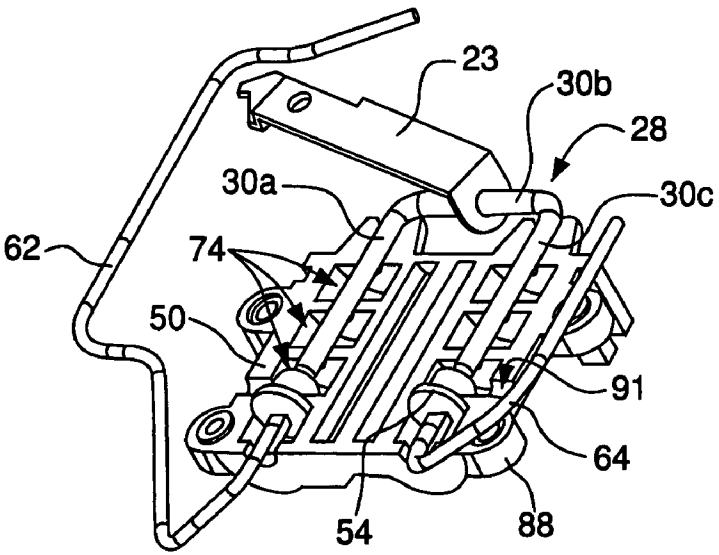
FIG. 5A is a bottom-side perspective view of the interrupter assembly shown in FIGS. 3 and 4, with the second half of the housing removed and showing a moving contact assembly of the interrupter assembly in a closed position.

The actuator assembly 18 comprises a contact arm 23 and a contact arm spring 24. The contact arm 23 is movable between a first, or closing position (FIGS. 1, 3 and 5A) and a second, or opening position (FIG. 5B). The contact arm spring 24 biases the contact arm 23 toward the opening position. The actuator assembly 18 also comprises a linkage 26 mechanically coupled to the contact arm 23.

The current sensor assembly 16 retains the contact arm 23 in its closing position by way of the linkage 26 during normal operation of the distribution transformer 100, i.e., while the distribution transformer 100 is not subject to an over-current or over-temperature condition. In particular, the magnetic element 22 produces a magnetic force that restrains the linkage in the position depicted in FIG. 1 during normal operation of the distribution transformer 100.

The current sensor assembly 16 releases the linkage 26 in response to an over-current or over-temperature condition in the distribution transformer 100, thereby permitting the contact arm 23 to translate into its opening position in response to the bias of the contact arm spring 24. More specifically, an over-current or over-temperature condition heats the magnetic element 22. The strength of the magnetic force produced by the magnetic element 22 decreases as the temperature of the magnetic element 22 increases. Heating the magnetic element 22 to a sufficient extent causes the strength of the magnetic force to decrease to a level at which the magnetic force can no longer retain the contact arm 23 in its closing position.

It should be noted that the current sensor assembly 16 has been described as a thermal-magnetic sensor for exemplary purposes only. Other types of sensors can be used in the alternative. Moreover, the actuator assembly 18 has been described in detail for exemplary purposes only. Other configurations for the actuator 18 can be used in alternative embodiments.

The interrupter assembly 12 includes a moving contact assembly 28 comprising a conductor 30, a first moving contact 32, and a second moving contact 34 (see FIGS. 3–5B). The conductor 30 includes a first leg 30*a*, a second leg 30*b* that adjoins the first leg 30*a*, and a third leg 30*c* that adjoins the second leg 30*b*. The second leg 30*b* is substantially perpendicular to the first and third legs 30*a*, 30*c*. The first and third legs 30*a*, 30*c* are substantially equal in length. This configuration gives the conductor 30 a substantially U-shaped configuration.

The first moving contact 32 is mounted on an end of the first leg 30*a*, and the second moving contact 34 is mounted on an end of the third leg 30*c*. The first and second moving contacts 32, 34 preferably are formed from a material suitable for exposure to the electric arcs that form within the circuit breaker 10 during actuation thereof. For example, the first and second moving contacts 32, 34 can be formed from copper tungsten.

The interrupter assembly 12 also includes a first contact/spring assembly 46 and a second contact/spring assembly 48 (see FIGS. 3–5B). The first contact/spring assembly 46 comprises a first stationary contact 50 and a spring 52 (the spring 52 is not pictured in FIG. 5A or 5B, for clarity). The first stationary contact 50 has a bore 53 formed therein for receiving the first moving contact 32. The second contact/spring assembly 48 comprises a second stationary contact 54 and a spring 56 (the spring 56 is not pictured in FIG. 5A or 5B, for clarity). The second stationary contact 54 has a bore 57 formed therein for receiving the second moving contact 34.

The interrupter assembly 12 also comprises a first lead 62 and a second lead 64 (see FIGS. 1–5B). The first lead 62 is electrically connected to the first stationary contact 50 and the current sensor assembly 16. The second lead 64 is electrically connected to the second stationary contact 54 and the voltage source 104.

The interrupter assembly 12 further includes a body 70 having a first half 70*a* and a second half 70*b*. The moving contact assembly 28 and the first and second contact/spring assemblies 46, 48 are mounted on the body 70, as discussed below. The body 70 is formed from an electrically-insulating material. Preferably, the body 70 is formed from a material resistant to the carbonizing (tracking) that potentially can result from the effects of an electric arc.

A first plurality of recesses 74 are formed in the first half 70*a*, proximate a first side 70*a*' thereof (see FIGS. 3–7). Each recess 74 preferably is defined, in part, by a curvilinear surface 76 that extends inward from a major surface 75 of the first half 70*a*. Each recess 74 is separated from adjacent recesses 74 by a rib 78.

Each rib 78 includes a curvilinear surface 80. Each curvilinear surface 80 extends inward from the major surface 75, and defines a recess 82. The recesses 82 receive a portion of the first leg 30*a* of the conductor 30, as discussed below.

A recess 84 is formed in the first half 70*a*, proximate a lower edge thereof. (Directional terms such as lower, upper, downward, upward, etc. are used in reference to the component orientations depicted in FIGS. 4 and 7.) The recess 84 extends inward for the major surface 75, and accommodates the first stationary contact 50 and the spring 52.

A second plurality of the recesses 74 and ribs 78 are formed in the first half 70*a*, proximate a second side 70*a*" thereof. The recesses 80 formed in the second plurality of the ribs 78 receive the third leg 30*c* of the conductor 30. In addition, another of the recesses 84 is formed in the first half 70*a* for accommodating the second stationary contact 54 and the spring 56.

Two elongated recesses 90 preferably are formed in the first half 70*a*, proximate a centerline thereof (see FIGS. 3–7). The recesses 90 extend inward from the major surface 75, and accommodate an elastomeric sealing material.

Two recesses 91 preferably are formed in the first half 70*a*, and extend inward from the major surface 75. A first of the recesses 91 extends from one of the lowermost recesses 74 to the first side 70*a*'. A second of the recesses 91 extends from the other of the lowermost recesses 74 to the second side 70*a*".

The second half 70*b* of the body 70 includes a major surface 75, and is configured with recesses 74, 82, 84, 90, 91 and ribs 78 in a manner substantially identical to the first half 70*a*.

Figure 7:
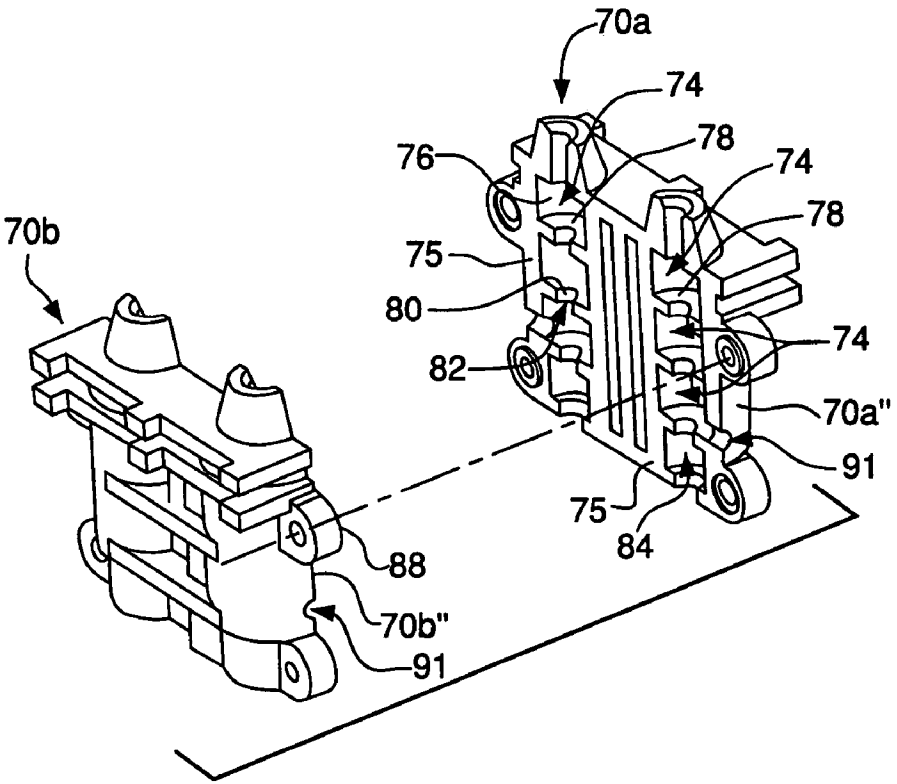
FIG. 7 is an exploded, top-side perspective view of the first and second halves of the housing of the interrupter assembly shown in FIGS. 3–6.
Figure 6:
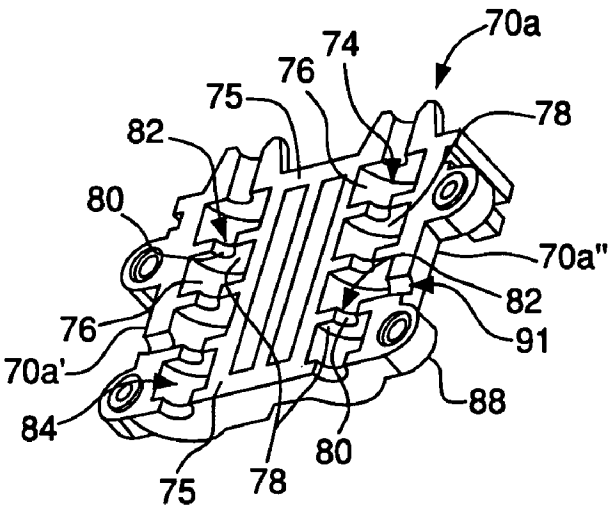
FIG. 6 is a bottom-side perspective view of a first half of the housing of the interrupter assembly shown in FIGS. 3–5B.
Figure 8:
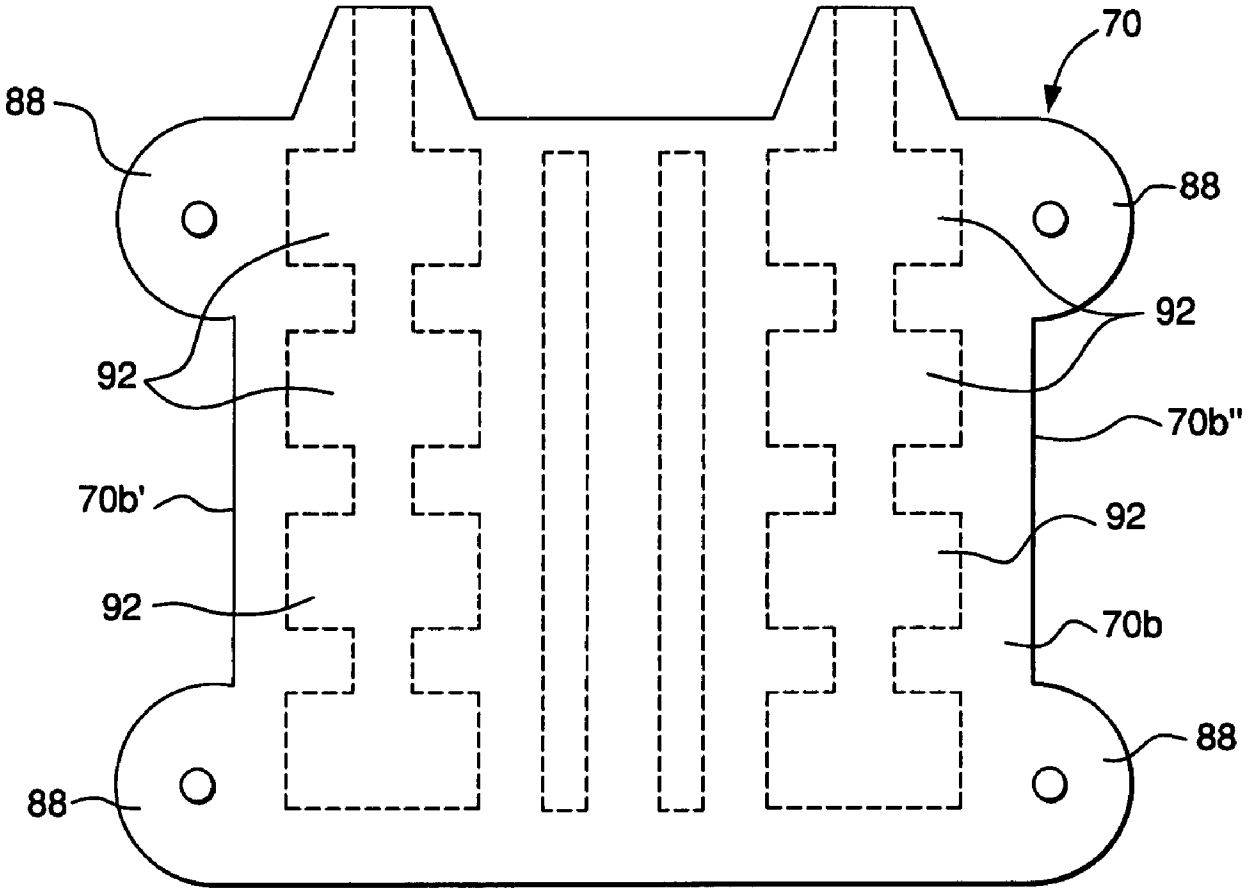
FIG. 8 is a side view of the interrupter assembly shown in FIGS. 3–7 in an assembled state, and depicting a plurality of interruption chambers of the interrupter assembly in phantom.
Figure 9:
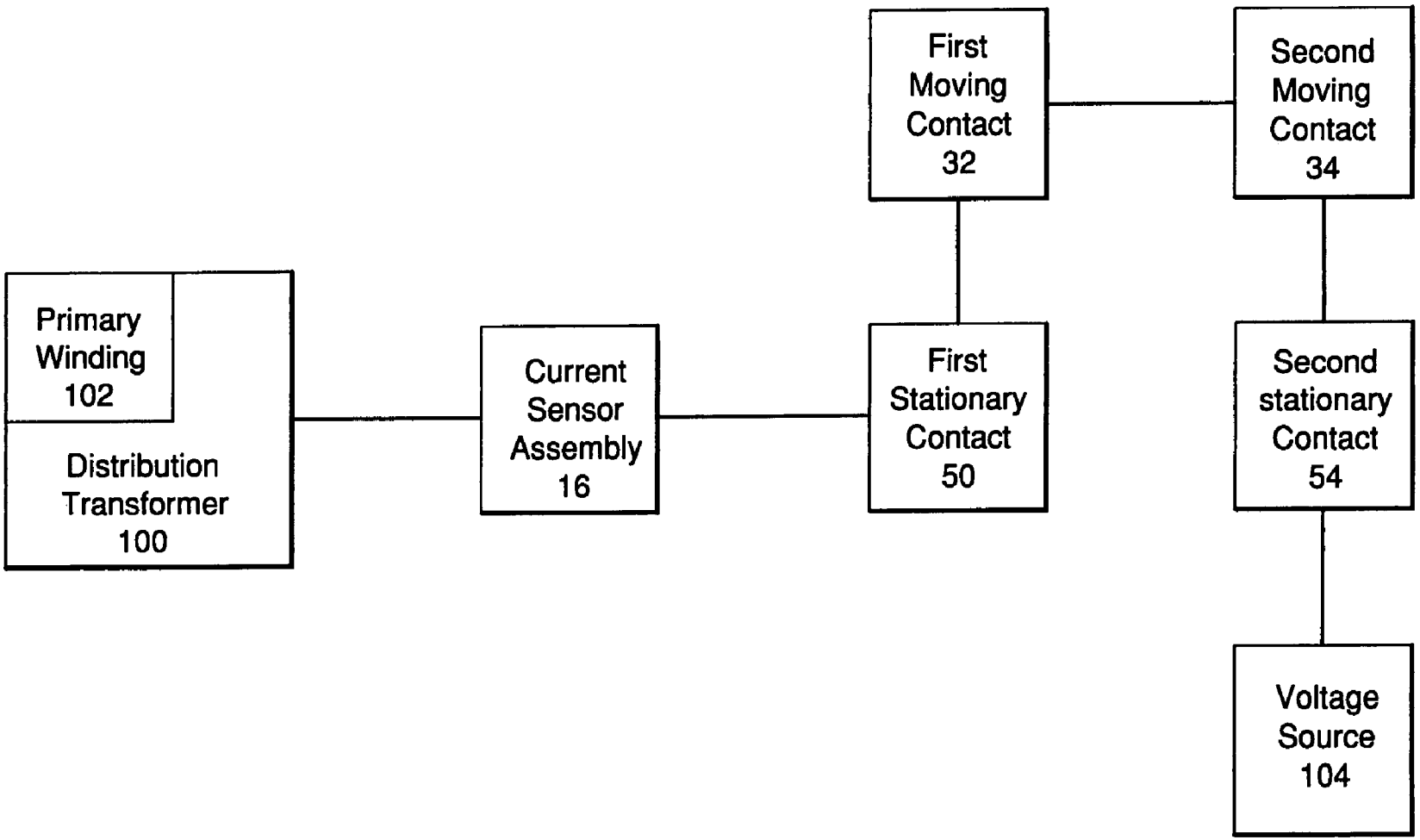
FIG. 9 is a schematic illustration of an electrical circuit that includes the circuit breaker shown in FIGS. 1–8.

The first half 70*a* is secured to (mated with) the second half 70*b* so that the major surface 75 of the first half 70*a* abuts the major surface 75 of the second half 70*b* (see FIG. 7). The first and second halves 70*a*, 70*b* can be secured using a suitable means such as fasteners (not shown) accommodated by flanges 88 formed in the first and second halves 70*a*, 70*b*.

Each recess 74 formed in the first half 70*a* faces a corresponding one of the recesses 74 formed in the second half 70*b* when the first and second halves 70*a*, 70*b* are mated. Each set of corresponding recesses 74 defines a cylindrically-shaped interruption chamber 92 (see FIG. 8).

(The interruption chambers 92 can be formed with a shape other than cylindrical in alternative embodiments.)

The interruption chambers 92 are filled with the insulating fluid used in the distribution transformer 100. The insulating fluid helps to extinguish the electric arcs that occur within the circuit breaker 10 as the moving contact assembly 28 moves from its closed to its open position, as discussed below.

The body 70 houses the moving contact assembly 28. In particular, each recess 82 defined by the first half 70*a* faces a corresponding recess 82 defined by the second half 70*b*. Each corresponding set of recesses 82 accommodates the first leg 30*a* or the third leg 30*c* of the conductor 30. (The interruption chambers 92 and recesses 82 associated with the first leg 30*a* are aligned to permit the first leg 30*a* to extend therethrough. The interruption chambers 92 and the recesses 82 associated with the third leg 30*c* likewise are aligned to permit the third leg 30*c* to extend therethrough.)

The curvilinear surfaces 80 of each rib 78 are sized to permit the first leg 30*a* and the third leg 30*c* to fit snugly within the corresponding recesses 82, and to permit the first and the third legs 30*a*, 30*c* to slide upward and downward within the body 70 with a reciprocating motion.

The moving contact assembly 28 can reciprocate between a closed position (FIGS. 3 and 5A) and an open position (FIG. 5B) in relation to the body 70 and the first and second stationary contacts 50, 54. In particular, the contact arm 23 is mechanically coupled to the second leg 30*b* of the conductor 30 so that movement of the contact arm 23 between the closing and opening positions moves the moving contact assembly 28 between its respective closed and open positions.

Figure 4:
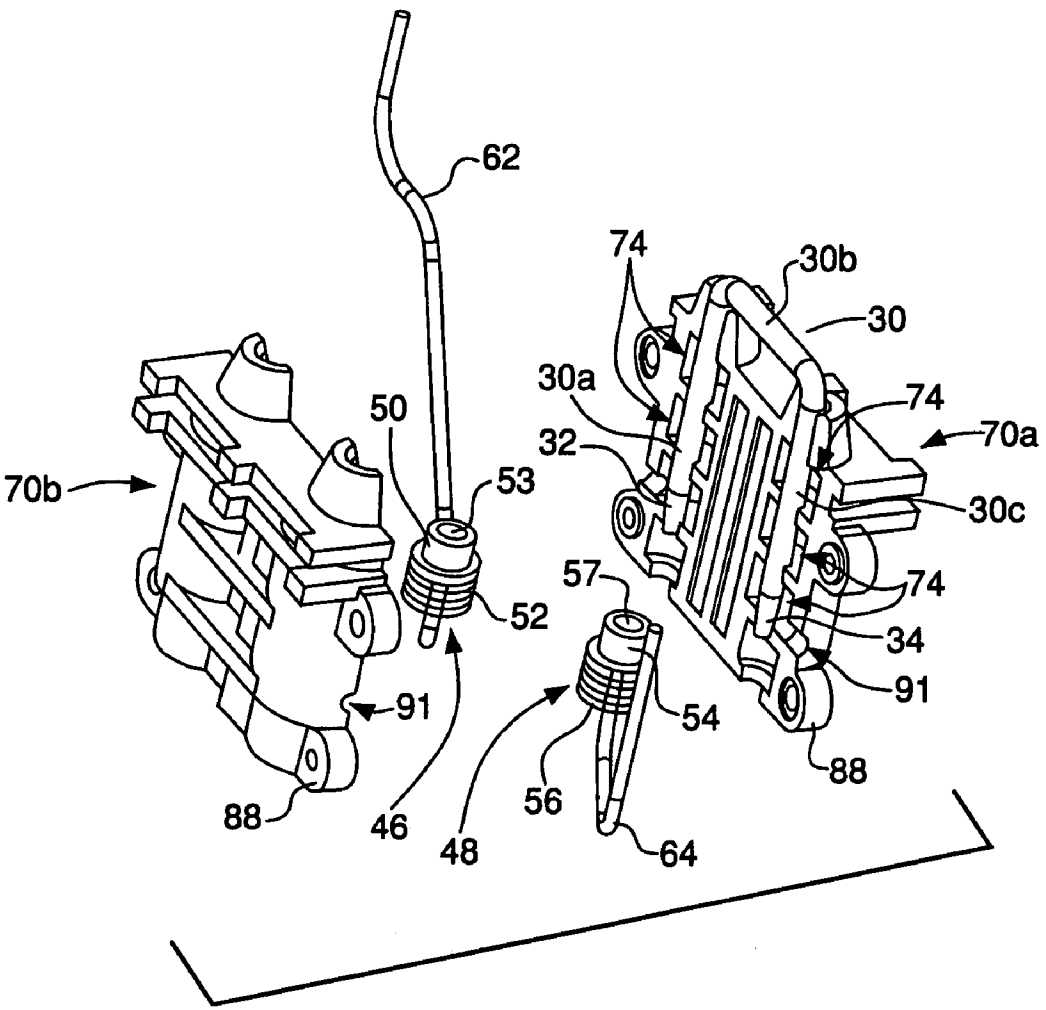
FIG. 4 is an exploded, top-side perspective view of the interrupter assembly shown in FIG. 3.

The first and second stationary contacts 50, 54 receive the respective first and second moving contacts 32, 34 when the moving contact assembly 28 is in its closed position. (The first and second moving contacts 32, 34 preferably are tapered, as shown in FIGS. 4 and 5B, to facilitate mating with the first and second stationary contacts 50, 54.) Electrical contact between the moving contact assembly 28 and the respective first and second stationary contacts 50, 54 therefore is established, and the current path between the primary winding 102 and the voltage source 104 is uninterrupted when the moving contact assembly 28 is in its closed position.

The first and second stationary contacts 50, 54 can move in relation to the body 70 to a limited extent, in substantially the same direction as the first and second moving contacts 30, 32. The spring 52 of the first contact/spring assembly 46 and the spring 56 of the second contact/spring assembly 48 bias the respective first and second stationary contacts 50, 54 toward the first and second moving contacts 30, 32. This feature can help to ensure that the degree of travel for the first and second moving contacts 30, 32 is sufficient to result in full engagement of the first and second moving contacts 30, 32 and the respective first and second stationary contacts 50, 54.

Movement of the moving contact assembly 28 from its closed to its open position causes the first and second moving contacts 32, 34 to separate from the respective first and second stationary contacts 50, 54, thereby breaking the current path between the primary winding 102 and the voltage source 104. (The contact assembly 28 is moved from its closed to its open position in response to an over-current in the primary winding 102 or an over-temperature condition in the distribution transformer 100, as discussed above.)

An electric arc (hereinafter "the first arc") forms between the first moving contact 32 and the first stationary contact 50 as the first moving contact 32 separates and backs away from the first stationary contact 50. Another electric arc (hereinafter "the second arc") forms between the second moving contact 34 and the second stationary contact 54 as the second moving contact 34 separates and backs away from the second stationary contact 54. The interruption chambers 92, it is believed, cause the first and second arcs to be extinguished more quickly than would otherwise be possible, for the following reasons.

The first moving contact 32 travels upward, through successive ones of the associated interruption chambers 92, as the moving contact assembly 28 moves toward its open position. Hence, the first arc is drawn upward through successive ones of the interruption chambers 92. The first arc, it is believed, causes the insulating fluid in the interruption chambers 92 to vaporize as the first arc reaches each interruption chamber 92 and heats the insulating fluid therein. (The vaporized insulating fluid can exit the body 70 by way of the recesses 91 formed in the first and second halves 70*a*, 70*b* proximate the respective sides 70*a*', 70*b*'.)

The second moving contact 34 likewise travels upward, through successive ones of the associated interruption chambers 92, as the moving contact assembly 28 moves toward its open position. The second arc thus is drawn upward through successive ones of the interruption chambers 92. The second arc, it is believed, causes the insulating fluid in the interruption chambers 92 to vaporize as the second arc reaches each interruption chamber 92 and heats the insulating fluid therein. (The vaporized insulating fluid can exit the body 70 by way of the recesses 91 formed in the first and second halves 70*a*, 70*b* proximate the respective sides 70*a*", 70*b*".)

Adjacent interruption chambers 92 are substantially isolated from each other by a corresponding one of the ribs 78, and by the first leg 30*a* or the third leg 30*c* of the conductor 30. Hence, the insulating fluid within each interruption chamber 92 is vaporized substantially independent of the insulating fluid in the other interruption chambers 92. This feature, it is believed, delays the vaporization of the insulating fluid in the interruption chambers 92 other than the lowermost interruption chambers 92. In other words, the vaporization of the insulating fluid in the lowermost interruption chambers 92 (which are the first to be exposed to the first and second arcs) does not accelerate the vaporization of the insulating fluid in the other interruption chambers 92.

Moreover, the use of multiple interruption chambers 92, it is believed, prevents or discourages non-vaporized insulating fluid in the upper interruption chambers 92 from being expelled and displaced by the vaporized insulating fluid from the lower interruption chambers 92.

The use of multiple interruption chambers 92 thus causes the first and second arcs to be exposed to non-vaporized insulating fluid (which is more effective at extinguishing an electric arc than vaporized insulating fluid) for a longer period than otherwise would be possible. Hence, the interruption rating of the interrupter assembly 12 is believed to be higher than that of a comparable circuit breaker having a single arc chamber.

The elastomeric material in the recesses 90 helps to prevent the vaporized insulating fluid from the interruption chambers 92 associated with the first leg 30*a* of the conductor 30 from leaking into the interruption chambers 92 associated with the third leg 30*c*, and vice versa.

The U-shape of the conductor 30 causes the first moving contact 32 to be drawn away from the first stationary contact 50 as the second moving contact 34 is drawn away from the second stationary contact 54. Hence, the first and second arcs are formed on a substantially simultaneous basis. This feature, it is believed, can give the circuit breaker 10 a higher interruption rating than would otherwise be possible. In particular, the electrical energy being interrupted by the circuit breaker 10 is divided between two sets of stationary and moving contacts, thereby producing two arcs of relatively low energy (as compared to the single arc produced in a conventional interrupter assembly of comparable capability).

The U-shape of the conductor 30 can permit the simultaneous formation of two arcs using only a single set of moving components. In other words, both moving contacts 32, 34 can be actuated using the same actuator assembly 18. Hence, a second electric arc can be produced without substantially increasing the parts count of the circuit breaker 10.

Moreover, the U-shaped conductor 30 is relatively compact. Hence, the external dimensions of the interrupter assembly 12 are believed to be comparable to, or smaller than those of a conventional interrupter assembly that produces only one electric arc.

The configuration of the body 70 permits the interruption chambers 92 to be formed without a need to stack individual cylinders. In particular, the recesses 74 in the first and second halves 70*a*, 70*b* are configured so that the recesses 74 form the interruption chambers 92 when the first and second halves 70*a*, 70*b* are mated. Hence, multiple interruption chambers 92 can be formed without substantially increasing the parts count of the circuit breaker 10, and without the additional assembly steps associated with stacking the individual cylinders.

The foregoing description is provided for the purpose of explanation and is not to be construed as limiting the invention. While the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

For example, alternative embodiments of the circuit breaker 10 can be configured with only one of the moving contacts 32, 34 and one of the stationary contacts 50, 54. Other alternative embodiments can be configured with the U-shaped conductor 30 and a body that does not include the interruption chambers 92.

What is claimed is:

1. An interrupter assembly for a circuit breaker, comprising:

a first and a second stationary contact;

a moving contact assembly comprising a substantially U-shaped conductor, a first moving contact mounted on a first end of the conductor, and a second moving contact mounted on a second end of the conductor, the moving contact assembly being movable between a first position wherein the first and second moving contacts are in electrical contact with the respective first and second stationary contacts, and a second position wherein the first and second moving contacts are electrically isolated from the respective first and second stationary contacts; and a body having a first and a second half each having a plurality of recesses formed therein, wherein the recesses formed in the first half face corresponding ones of the recesses formed in the second half to form chambers for holding insulating fluid when the first and the second halves are mated, the first and second halves each comprise a plurality of ribs, each of the ribs has a recess formed therein for receiving a corresponding one of the first and second moving contacts, each of the ribs of the first half faces a corresponding one of the ribs of the second half when the first and second halves are mated so that ribs encircle the first and second moving contacts and substantially isolate adjacent ones of the chambers, and the body receives the moving contact assembly so that the first and the second moving contacts are drawn through respective ones of the chambers and the ribs as the moving contact assembly moves from the first to the second position.

2. The interrupter assembly of claim 1, wherein each of the recesses is defined at least in part by a substantially curvilinear surface of one of the first and second halves.

3. The interrupter assembly of claim 1, wherein the chambers are substantially cylindrical.

4. The interrupter assembly of claim 1, wherein the first and second stationary contacts each have a bore formed therein for receiving the respective first and second moving contacts.

5. The interrupter assembly of claim 1, wherein the conductor comprises a first leg, a second leg adjoining the first leg, and a third leg adjoining the second leg, the first and third legs being of substantially equal length and being substantially perpendicular to the second leg.

6. The interrupter assembly of claim 1, wherein a first electric arc forms between the first moving contact and the first stationary contact, and a second electric arc forms between the second moving contact and the second stationary contact as the moving contact assembly moves from the first to the second position; and the first and the second arcs are drawn through respective ones of the chambers so that the first and the second arcs are extinguished by the insulating fluid.

7. The interrupter assembly of claim 6, wherein the first and the second moving contacts are drawn successively through adjacent ones of the respective chambers.

8. The interrupter assembly of claim 6, wherein the insulating fluid in each of the chambers is substantially isolated from the insulating fluid in adjacent ones of the chambers.

9. An interrupter assembly for a circuit breaker, comprising a first and a second stationary contact, and a moving contact assembly comprising:

a conductor having a first leg, a second leg adjoining the first leg, and a third leg adjoining the second leg, the first and third legs being substantially perpendicular to the second leg and having substantially the same length so that the conductor is substantially U-shaped;

a first moving contact mounted on the first leg;

a second moving contact mounted on the second leg, the moving contact assembly being movable between a first position wherein the first and the second moving contacts electrically and mechanically contact the respective first and second stationary contacts, and a second position wherein the first and second moving contacts are electrically isolated from the respective first and second stationary contacts; and a body for housing the moving contact assembly and the stationary contacts, wherein the body has a first and a second half each having a plurality of recesses formed therein, the recesses formed in the first half face corresponding ones of the recesses formed in the second half to form chambers for holding insulating fluid when the first and the second halves are mated, the first and the second halves each have a plurality of semi-circular ribs formed therein, the ribs of the first half each face a corresponding one of the ribs of the second half when the first and second halves are mated so that the corresponding ribs of the first and second halves define upper and lower boundaries of the chambers and encircle the first and the second moving contacts whereby the ribs substantially isolate adjacent ones of the chambers.

10. The interrupter assembly of claim 9, wherein the substantial U shape of the conductor causes the first moving contact and the second contact to separate from the respective first and second stationary contacts on a substantially simultaneous basis as the moving contact assembly moves from the first to the second position.

11. An interrupter assembly for a circuit breaker, comprising:

a first contact;

a conductor;

a second contact mounted on the conductor, the second contact and the conductor being movable in relation to the first contact between a first position wherein the first and the second contacts are in electrical contact, and a second position; and a body having a first and a second half each having a plurality of recesses formed therein, the recesses forming chambers within the body for holding insulating fluid when the first and the second halves are mated, the first and second halves of the body each comprising a plurality of ribs each having a substantially planar first surface that partially defines one of the chambers, and a substantially planar second surface that partially defines an adjacent one of the chambers, the body receiving the second contact and the conductor so that the conductor and the second contact are drawn through the chambers as the second contact moves from the first to the second position.

12. The interrupter assembly of claim 11, wherein each of the recesses is defined at least in part by a substantially curvilinear surface of one of the first and the second halves.

13. The interrupter assembly of claim 11, wherein the chambers are substantially cylindrical.

14. The interrupter assembly of claim 11, wherein an electric arc forms between the first and the second contacts as the conductor and the second contact move from the first to the second position, and the arc is drawn through the chambers so that the arc is extinguished by the insulating fluid.

15. The interrupter assembly of claim 11, wherein the second contact is drawn successively through adjacent ones of the chambers.

16. The interrupter assembly of claim 11, wherein the insulating fluid in each of the chambers is substantially isolated from the insulating fluid in adjacent ones of the chambers.

17. The interrupter assembly of claim 14, wherein the electric arc is drawn through the chambers and extinguished by the insulating fluid.

18. The interrupter assembly of claim 11, further comprising a third contact, wherein the conductor is substantially U-shaped and the first and the third contacts are mounted on opposing ends of the conductor.

19. The interrupter assembly of claim 16, wherein the ribs substantially isolate adjacent ones of the chambers.

20. An interrupter assembly for a circuit breaker, comprising:

a first contact;

a conductor;

a second contact mounted on the conductor, the second contact and the conductor being movable in relation to the first contact between a first position wherein the first and the second contacts are in electrical contact, and a second position wherein the second contact is electrically isolated from the first contact; and a body for receiving the first and the second contacts and the conductor, wherein the body comprises a first and a second half, the body has a plurality of chambers formed therein for holding insulating fluid; each chamber is defined by a recess formed in the first half, and a corresponding recess formed in the second half that adjoins the recess formed in the first half when the first and second halves are mated; the chambers are further defined by ribs formed in the first and second halves; each of the ribs of the first half faces a corresponding rib formed in the second half when the first and second halves are mated so that the corresponding ribs of the first and second halves are symmetrically disposed around the moving contact; and the second contact is drawn through the chambers when the second contact moves from the first to the second position.

21. The interrupter assembly of claim 20, further comprising a third contact, wherein the conductor is substantially U-shaped and the first and the third contacts are mounted on opposing ends of the conductor.

22. A circuit breaker, comprising:

an interrupter assembly comprising:

a first and a second stationary contact;

a moving contact assembly comprising a substantially U-shaped conductor, a first moving contact mounted on a first end of the conductor, and a second moving contact mounted on a second end of the conductor, the moving contact assembly being movable between a first position herein the first and second moving contacts are in electrical contact with the respective first and second stationary contacts, and a second position wherein the first and second moving contacts are electrically isolated from the respective first and second stationary contacts; and a body having a first and a second half each having a plurality of recesses formed therein, wherein the recesses formed in the first half face corresponding ones of the recesses formed in the second half to form chambers for holding insulating fluid when the first and the second halves are mated, the first and second halves each comprise a plurality of ribs, each of the ribs has a recess formed therein for receiving a corresponding one of the first and second moving contacts, each of the ribs of the first half faces a corresponding one of the ribs of the second half when the first and second halves are mated so that ribs encircle the first and second moving contacts and substantially isolate adjacent ones of the chambers, and the body receives the moving contact assembly so that the first and the second moving contacts are drawn through respective ones of the chambers and the ribs as the moving contact assembly moves from the first to the second position;

an actuator assembly for moving the moving contact assembly from the first to the second position, comprising a contact arm mechanically coupled to the conductor, and a spring for biasing the contact arm; and a current sensor assembly for activating the actuator mechanism in response to over-temperature and over-current conditions.

23. The interrupter assembly of claim 1, wherein each of the ribs is semi-circular and each of the recesses ribs is semi-circular.

24. The interrupter assembly of claim 23, wherein the recesses are sized so that the first and second moving contacts fit snugly within the recesses.

25. The interrupter assembly of claim 1, wherein the each of the ribs has a substantially planar upper surface and a substantially planar lower surface.

26. The interrupter assembly of claim 25, wherein the upper surface of each of the ribs forms a lower end of one of the chambers, and the lower surface of each of the ribs forms an upper end of another one of the chambers.

27. The interrupter assembly of claim 25, wherein each of the ribs includes an edge adjoining the upper and lower surfaces of the rib, and the edges of the ribs of the first half each abut an edge of a corresponding one of the ribs of the second half when the first and the second halves are mated.

28. The interrupter assembly of claim 1, wherein corresponding ones of the ribs of the first and the second halves are symmetrically disposed around the first and second moving contacts.

* * * * *